United States Patent [19]

Eldon, III et al.

[11] 4,324,432

[45] Apr. 13, 1982

[54] INFANT SWING CARRIER

[75] Inventors: James Eldon, III, Barto; David Saint, Elverson; Thomas L. Latone, Quakertown, all of Pa.

[73] Assignee: Graco Metal Products, Inc., Elverson, Pa.

[21] Appl. No.: 152,956

[22] Filed: May 23, 1980

[51] Int. Cl.[3] ..... B60N 1/02; A47C 1/00

[52] U.S. Cl. ..... 297/377

[58] Field of Search ..... 297/183, 130, 327, 372, 297/364, 365, 281, 377, 280, 373, 310; 16/110; 272/88

[56] References Cited

U.S. PATENT DOCUMENTS

| | | | |
|---|---|---|---|
| D. 228,268 | 9/1973 | Saint | D6/10 |
| 3,099,484 | 7/1963 | Williams et al. | 297/280 |
| 3,334,944 | 8/1967 | Gould et al. | 297/377 |
| 3,409,325 | 11/1968 | Hamilton et al. | 297/377 |
| 3,976,328 | 8/1976 | Stamez | 297/377 |

*Primary Examiner*—Ronald Feldbaum

*Attorney, Agent, or Firm*—Seidel, Gonda, Goldhammer & Panitch

[57] ABSTRACT

An infant carrier has a handle which can be detachably coupled to a hanger on a swing. The handle is U-shaped and pivotably connected at its free ends to the carrier shell body by a latch means so that the handle can be latched in different angular positions.

12 Claims, 8 Drawing Figures

FIG. 1
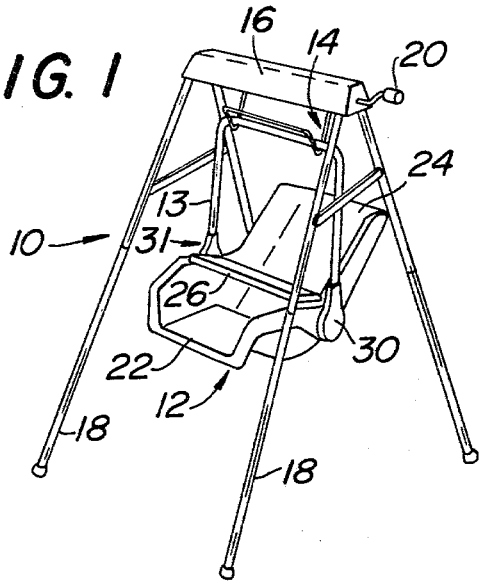
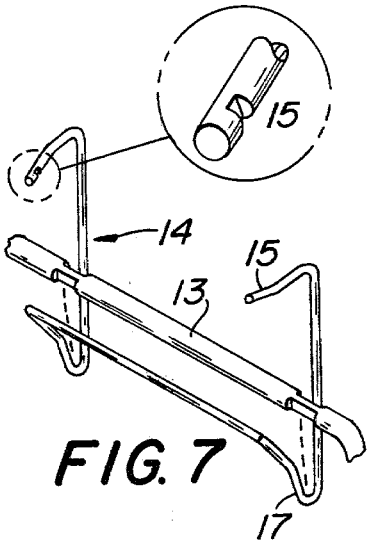
FIG. 7
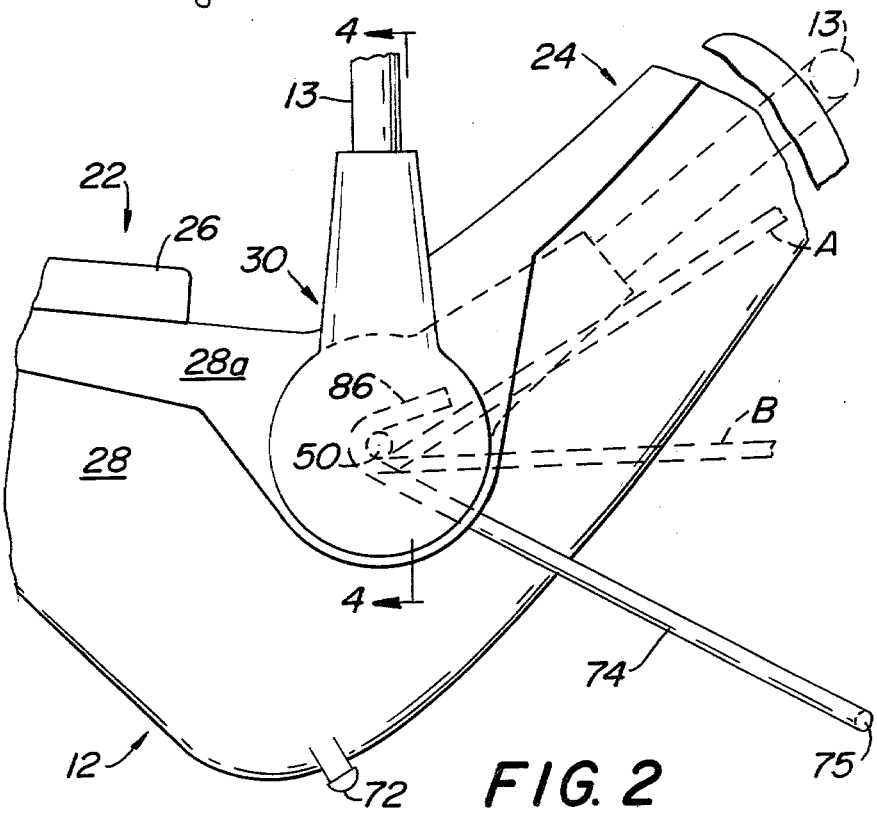
FIG. 2

INFANT SWING CARRIER

BACKGROUND

Infant swings of the general type involved herein are known from U.S. Pat. Des. No. 228,268. A swing seat construction is known from U.S. Pat. No. 3,099,484. A U-shaped tilt wire for an infant carrier is known from U.S. Pat. No. 3,976,328. An infant carrier having a pivotably mounted carrying handle with or without a latch is taught by U.S. Pat. Nos. 3,334,944 and 3,409,325.

SUMMARY OF THE INVENTION

A preferred embodiment of the present invention is directed to an infant carrier having a carrying handle and a tilt wire support member to facilitate supporting the carrier on a surface therebelow. The carrier handle may be used for carrying the carrier and/or for detachably coupling the handle to a swing hanger. The infant carrier has a body for supporting an infant. The handle is a generally U-shaped handle which is pivotably coupled at its free ends to the carrier body with the bight portion thereof extending transverse of the carrier. A manually operable latch means is provided for latching the free ends of the handle in different angular positions relative to the carrier body. The tilt support member is pivotable relative to the body and is independently latched to the body in various angular positions.

It is an object of the present invention to provide an infant swing carrier which may be supported by a surface from below, may be carried by a handle, and may be detachably coupled to a swing by the handle.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a swing incorporating the carrier of the present invention.

FIG. 2 is an enlarged partial side elevation view of the carrier.

FIG. 7 is a perspective view of a hanger.

FIG. 7A is an enlarged view of the upper ends of the hanger.

Figure 3:
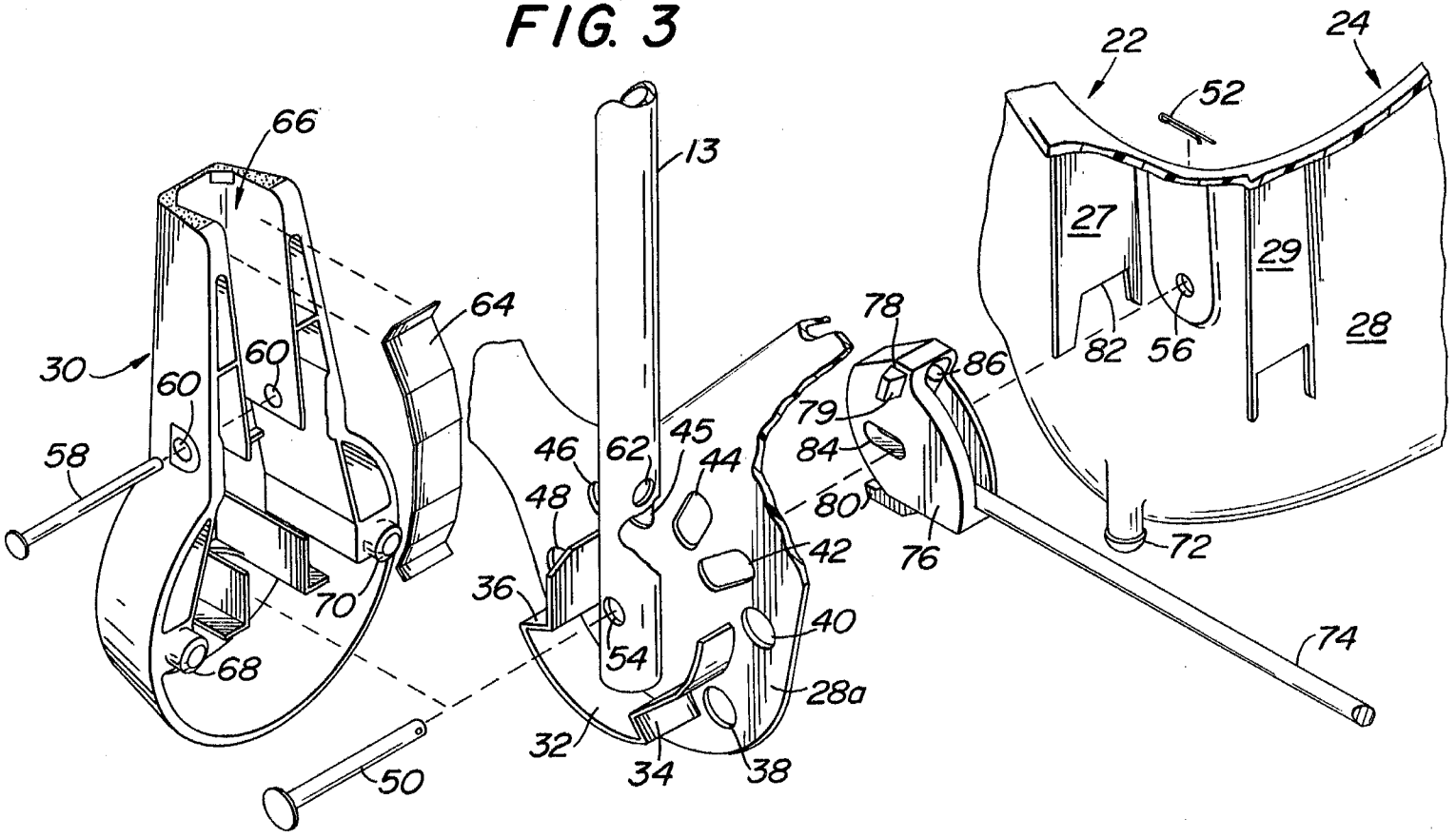
FIG. 3 is an exploded perspective view of the latch means.

Referring to the drawings in detail, wherein like numerals indicate like elements, there is shown in FIG. 1 a swing designated generally as 10. An infant carrier 12 is detachably coupled to an oscillating portion of the housing 16 by way of a hanger 14. The hanger 14 is shown more clearly in FIG. 7 wherein the hooks at the upper ends 15 are detachably coupled to the oscillating portion of housing 16 while the lower ends form a trough or channel for receiving the bight portion of the U-shaped handle 13.

The bight portion of handle 13 has two flats at the locations where it closely mates with and contacts the V-shaped portions 17 of the hanger 14. The flats on handle 13 and the portions 17 cooperate to transmit the oscillation of hanger 14 to the handle 13 without relative pivoting therebetween. The hook ends 15 of hanger 14 are bent toward each other and are notched on their inner surfaces so that hanger 14 can be attached to housing 16 without fasteners. That is a distinct advantage.

The handle 13 is U-shaped and each of its ends is pivotably coupled to one of the sides of the carrier 12. Oscillation of the carrier 12 may be attained manually by way of actuator 20 or by way of a motor. The housing 16 is supported at its ends by a frame having two sets of upwardly converging legs 18.

The carrier 12 has a seat portion 22 connected to a back portion 24. A tray-retainer 26 extends across the seat portion 24 and is removably attached thereto in a conventional manner. The carrier 12 is preferably constructed in the form of a polymeric plastic shell with a pad (not shown) removably attached to the seat and back portions 22, 24. The body or shell 28 is molded in one integral piece with a downwardly extending flange **28*a* spaced from the sides of the shell and generally parallel thereto. See FIGS. 2 and 4. The flange 28*a* is integral with the shell 28 by way of the outwardly extending lip at the top of the flange and by way of spaced parallel ribs 27, 29. See FIGS. 3 and 4**.

The free ends of the handle 13 are pivotably connected to the opposite sides of the carrier 12 for limited pivotable movement through an arc of about 45° as indicated by the solid lines and phantom lines in FIG. 2. A latch 30 is provided on one side of the carrier 12 and a mating latch 31 is provided on the opposite side. The latches are identical. Hence, only latch 30 will be described in detail.

The latch 30 is manually operable and constructed in a manner so as to lock the handle 13 in any one of several preset positions whereby oscillation of the handle 13 by hanger 14 will oscillate the carrier 12. As shown more clearly in FIG. 3, the flange **28*a* has an outwardly extending curved guard 32. Guard 32 extends radially inwardly at spaced points to define limit stops 34 and 36. The limit stops 34 and 36 are located on an imaginary circle which also contains a plurality of openings such as holes 38, 40, 42, 44, 45, 46 and 48 in the flange 28*a***.

Figure 4:
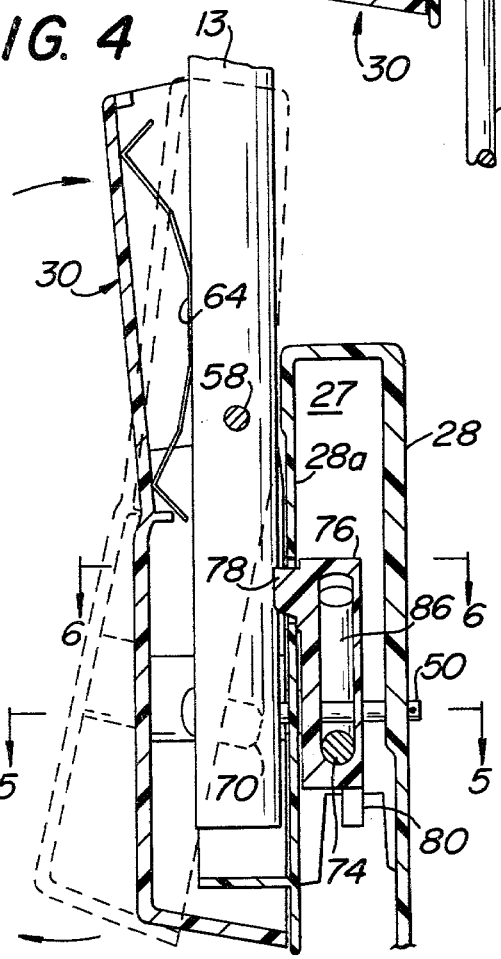
FIG. 4 is a sectional view taken along the line 4—4 in FIG. 2.

A pin 50 extends through a hole 54 in the lower end portion of handle 13, through a mating hole in flange **28*a*, and through a hole 56 in the shell 28. Pin 50 is releasably secured in position by a cotter 52. In this manner, the handle 13 may pivot about the longitudinal axis of pin 50. A pin 58 extends through aligned holes 60 in the latch 30 and through a hole 62 in the handle 13. The axes of holes 54 and 62 are mutually perpendicular. Latch 30 may pivot with respect to the handle 13 about the longitudinal axis of pin 58. In this regard, see the solid line and phantom positions of the latch 30 as shown in FIG. 4. Latch 30 is biased to the solid line position by the leaf spring 64 disposed within the channel 66 of the latch 30**.

As shown more clearly in FIG. 3, the latch 30 has a pair of parallel projections 68, 70 on a surface thereof juxtaposed to the flange **28*a*. Projection 68 is adapted to be selectively positioned in one of the holes 38, 40 and is adapted to contact the limit stop 34. Similarly, projection 70 is adapted to be positioned in one of the holes 46, 48 and is adapted to contact the limit stop 36. In order to change the position of the latch 30, and attain withdrawal of the projections 68, 70 from a pair of the holes in the flange 28*a*, the latch 30 is pivoted about the axis of pin 58 from the solid line position to the phantom position as shown in FIG. 4 and is then pivoted with the handle 13 about the longitudinal axis of the pin 50. Upon releasing the latch 30, spring 64 expands and causes the projections 68, 70 to enter a pair of the holes 38, 40, 46, 48 opposite thereto in the flange 28***a*. Thus, the handle 13 may be latched in two positions relative to the shell 28 with the operative position shown in solid lines and the inoperative position shown in phantom lines. Handle 13 does not have a position wherein projections 68, 70 can enter holes 42, 44, and 45.

A U-shaped tilt wire support member 74 cooperates with legs 72 to support the carrier 12 on a surface therebelow. Member 74 is movable from an inoperative phantom position A to a first operative phantom position B to a second operative position shown in solid lines in FIG. 2. Each leg of member 74 is connected to a discrete latch member 76 (only one shown). See FIG. 3. Member 76 has a projection 78 adapted to be received in one of the holes 42, 44 and 45.

Figure 5:
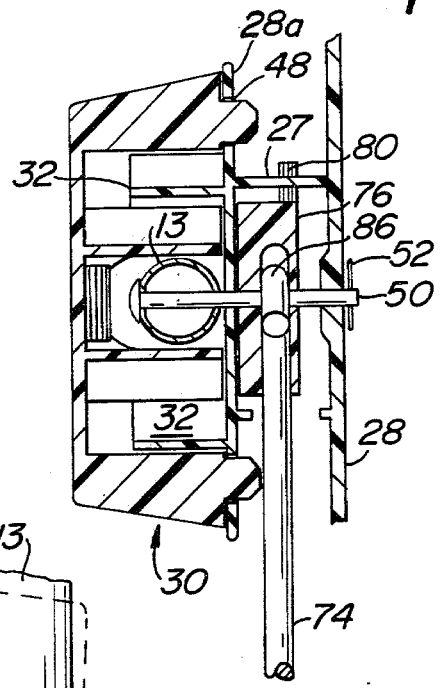
FIG. 5 is a sectional view taken along the line 5—5 in FIG. 4.
Figure 6:
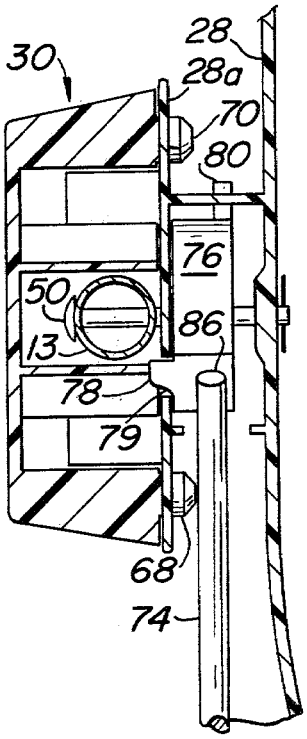
FIG. 6 is a sectional view taken along the line 6—6 in FIG. 4.

Latch member 76 is between shell 28 and flange 28*a*. See FIGS. 4–6. Member 76 has a projection 80 adapted to contact limit stop 82 on the bottom of rib 27 when member 74 is in the solid line position and projection 78 is adjacent to or disposed in hole 42. When projection 78 is in hole 44, member 74 is in the phantom B position. When projection 78 is in hole 45, member 74 is in the phantom A or inoperative position.

The legs on member 74 assume a normal position wherein the members 76 are spaced from each other by a distance greater than the distance between the flanges 28*a*. Hence, the projections 78 are spring biased away from each other into one of the holes 42, 44, 45. Pin 50 passes through slot 84 in member 76 and is trapped therein by a reverse bend 86 of the free end portion of the leg of member 74. See FIGS. 4 and 5.

To pivot member 74 clockwise in FIG. 2 about the axis of pin 50 from phantom position A to B or to the solid line position, it is not necessary to release projections 78. It is only necessary to pull on the bight portion 75. Cam 79 on a side face of each projection 78 contacts a side edge of the associated hole 42, 44, 45 and causes projections 78 to pop out of their associated hole. Continued clockwise movement of member 74 enables projections to snap into the next set of holes. Projections 78 are moved from one hole to another counterclockwise in FIG. 2 toward phantom position A by manually pushing the legs of member 74 towards each other and then pivoting member 74 about the axis of pin 50.

The latch 30 is on one side of flange 28*a* and latch member 76 is on the other with each cooperating with their own set of holes in flange 28*a*. Release of projections 68, 70 requires the latches 30, 31 to be pushed toward each other. Release of projections 78 when it is desired to move member 74 from its solid line position also requires that the latch members 76 be pushed toward each other. The latches 30, 31 and the latch members 76 all pivot about the axis of pin 50.

The carrier 12 may rest on legs 72 and member 74 in two angularly disposed operative positions. With handle 13 in its operative position, the carrier 12 may be carried or may be coupled to hanger 14 on the swing 10. Seatbelts may be provided if desired. With handle 13 and member 74 in their inoperative positions, the carrier 12 may be used in a conventional manner.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising:

(a) an infant carrier body, a generally U-shaped handle pivoted at its free ends to opposite sides of said body and with the handle bight being above and transverse of said body, (b) latch means for latching said handle in at least two positions relative to said body, one of said positions being an operative position, (c) a hanger for detachably coupling the handle bight to a swing when the handle is in its operative position, said handle bight and hanger having mating structure to prevent pivoting of the handle relative to the hanger.

2. Apparatus in accordance with claim 1 including a tilt support member pivoted to said body and adjustable between at least two positions, means for latching said tilt support member in said two positions thereof.

3. Apparatus in accordance with claim 2 wherein said handle and tilt support member pivot about a common axis.

4. Apparatus in accordance with claim 1 wherein said hanger has two free ends for attachment to a swing thereabove, means on said free ends for attaching the hanger to a swing without fasteners.

5. Apparatus in accordance with claim 2 wherein said latch means for said tilt member is constructed so that the tilt member will pivot from at least one of its operative positions only by the application of a manually applied pivoting force.

6. Apparatus in accordance with claim 5 wherein said latch means for said tilt member includes a projection pivotable therewith, said body having a plurality of holes for receiving said projection, a cam on a side face of said projection for withdrawing the projection from one of said holes in response to said force.

7. Apparatus comprising:

(a) an infant carrier body, a generally U-shaped handle pivoted at its free ends to opposite sides of said body and with the handle bight being above and transverse of said body, (b) latch means for latching said handle in at least two positions relative to said body, one of said positions being an operative position, (c) a tilt support member pivoted to said body and adjustable between two positions, means for latching said tilt support member in said two positions thereof.

8. Apparatus in accordance with claim 7 wherein said handle and tilt support member pivot about a common axis.

9. Apparatus in accordance with claim 7 including a flange depending from the upper edge of said body, said latch means cooperating with said flange to latch said handle.

10. Apparatus in accordance with claim 9 wherein said tilt support member is pivoted to said flange on a side opposite from said latch means, said tilt support member being between said flange and said body.

11. Apparatus in accordance with claim 7 wherein said latch means is pivoted to said handle.

12. Apparatus in accordance with claim 7 wherein said tilt support member is U-shaped with its free ends under tension and biased away from said body toward the free ends of said handle.

* * * * *